United States Patent [19]

Hardy

[11] 4,325,281

[45] Apr. 20, 1982

[54] DRUMHEAD RING REDUCER

[75] Inventor: Bruce N. Hardy, Elkhart, Ind.

[73] Assignee: Silver Street, Incorporated, Elkhart, Ind.

[21] Appl. No.: 165,273

[22] Filed: Jul. 2, 1980

[51] Int. Cl.[3] ..... G10D 13/02

[52] U.S. Cl. ..... 84/411 M; 84/414

[58] Field of Search ..... 84/411 R, 411 M, 414, 84/415

[56] References Cited

U.S. PATENT DOCUMENTS 3,026,759 3/1962 Kleiner et al. ..... 84/411 R 3,433,115 3/1969 Kjelstrom ..... 84/411 R

FOREIGN PATENT DOCUMENTS 944588 4/1949 France ..... 84/411 M

*Primary Examiner*—Lawrence R. Franklin

*Attorney, Agent, or Firm*—Marmaduke A. Hobbs

[57] ABSTRACT

A drumhead ring reducer for minimizing objectionable drumhead ring, in which a body of porous pliable material, such as polyester foam, is disposed within the drum shell and reacts with the drum membrane. An adhesive layer is disposed on the body for attaching the body to the drum shell, and a protective layer covers the adhesive during packaging and distribution. The body may be of a single segment or of a plurality of segments, each in contact with the membrane and disposed adjacent each other around the inner surface of the drum shell. The bodies will remain attached to the shell and operate effectively with a replacement membrane if the original membrane is removed.

14 Claims, 4 Drawing Figures

Fig. 3
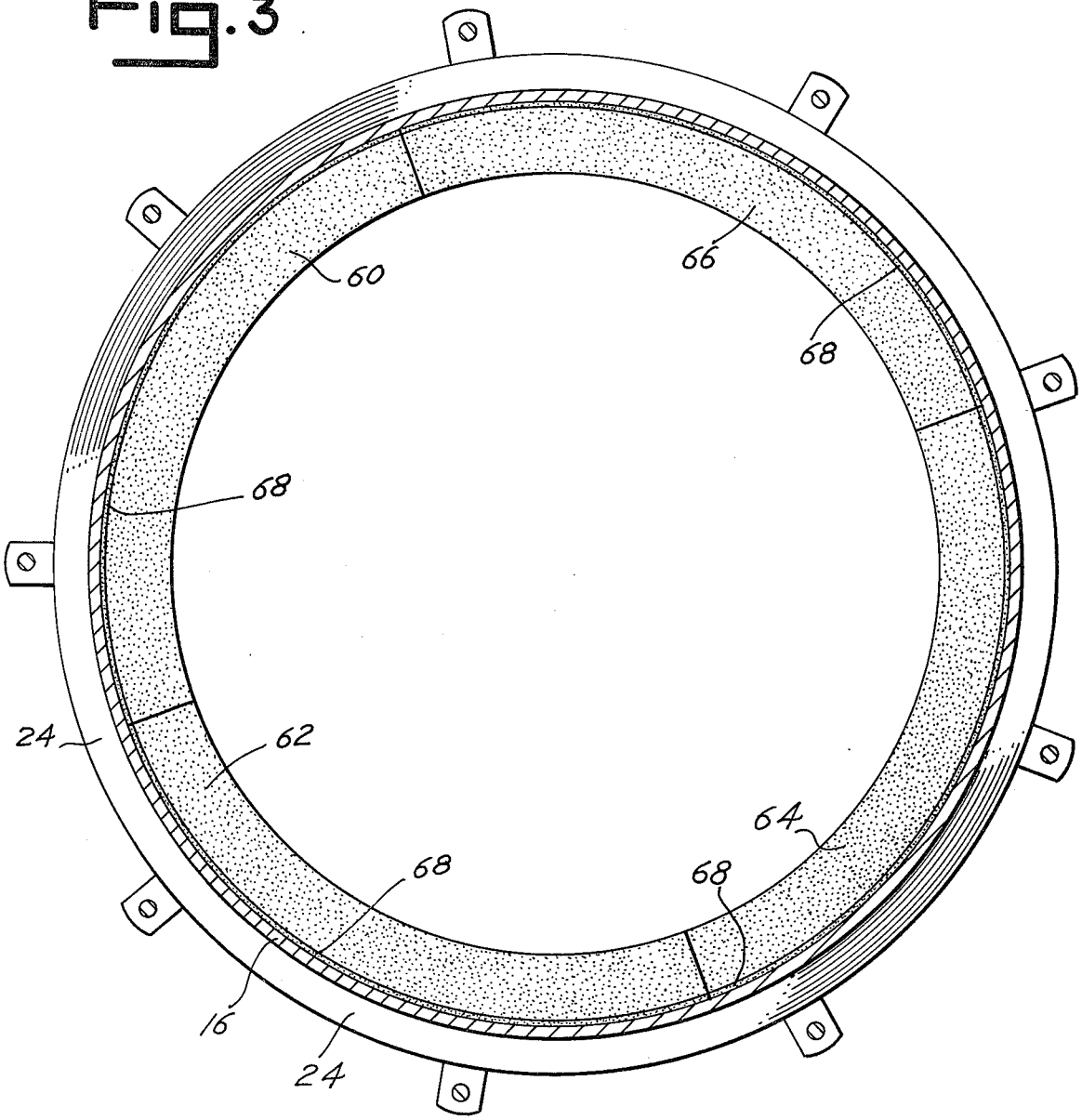
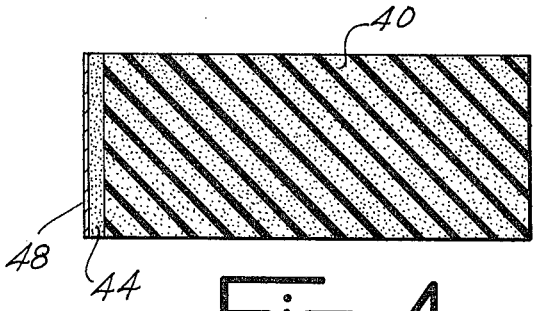
Fig. 4

DRUMHEAD RING REDUCER

Drumheads often exhibit a tonal phenomenon known as drumhead ring, or more simply, ringing, which is characterized by a distorted upper harmonic drum tone that varies in pitch as successive drum beats are induced. Ringing presented only a minor problem when drum membranes were made principally of natural products such as calfskin or other "gut" type materials. The natural product membranes exhibited only low levels of drumhead ring, often not noticeable to the average listener. With the increased popularity of synthetic drum membranes, ringing has presented a more severe problem. The synthetic membranes produce a more discernible ring of louder volume than do natural product membranes; thus, even a musically untrained listener may notice the distorted tone quality of the synthetic membrane. When electronic amplification is used to increase the volume of the drum sound, ringing becomes even more noticeable. As a result of some very significant advantages of synthetic membranes over natural product membranes, which make the use of synthetic membranes popular, it is highly desirable to minimize drumhead ring.

Oil filled hydraulic heads are available, which substantially reduce drumhead ring; however, in an effort to provide a less expensive alternative to the oil filled hydraulic heads which will eliminate ring, while retaining the utmost in percussive tonal quality, drummers have tried various approaches, with mixed results. Moderate success has been achieved in reducing ringing by placing soft materials such as rugs, pillows, or the like in the drum shell and against the drum membrane. While this approach may be of some utility to a stationary drummer, it is impractical at best for a marching drummer. The use of pillows or rugs is also unsightly, especially when transparent drum membranes are used, and traveling bands are inconvenienced by the need to carry the large bulky items. To some extent, pillows, rugs, or the like placed in the drum shell also retard the desired drum sound and projection, in addition to retarding ringing. Thus, the desired tone and volume of the drum may be adversely affected.

A device which effectively reduces drumhead ring, without substantially interfering with the desired drum tone, and without substantially adding to the weight of the drum, is disclosed in my U.S. patent for a "Drumhead Deadening Device", No. 4,244,266. The device disclosed in the aforementioned patent attaches directly to the drum membrane; hence, if the membrane is changed, a new device must be attached to the new membrane. At times this may be inconvenient, in that a spare deadening device must be carried to be available in the event that a drumhead breaks and has to be replaced. It is therefore one of the principal objects of the present invention to provide a drumhead ring reducer which attaches to the drum shell to operate effectively with the drum membrane to substantially reduce the ringing phenomenon commonly associated with synthetic membranes, while not interfering with the playing of the drum, and which will remain on the drumshell and not interfere with changing of the membrane, and will operate effectively to reduce ringing of a replacement membrane mounted on the shell.

Another object of the present invention is to provide a drumhead ring reducer which securely attaches to the drum shell while not adding significantly to the weight of the drum, permitting advantageous use of the ring reducer on drums carried by marching band members, and which attaches quickly, easily and securely so that only a one time installation is required, and traveling drummers need not carry the device apart from the drum, nor attach the device prior to each use of the drum.

A further object of the present invention is to provide the combination of a drum and a drumhead ring reducer which substantially reduces the ringing phenomenon while having no significant effect on the desired percussive tones, quality, and volume of the drum, and which can be used advantageously on dual headed drums to eliminate ringing of both the attack and resonating drumheads.

A still further object of the present invention is to provide a drumhead ring reducer which can be manufactured in a variety of colors and installed on the drum shell in a substantially imperceptible manner that does not interfere with the appearance of transparent drum membranes, and which can be manufactured inexpensively and in a manner for installation which requires only a minimal time and effort by the user of the device.

Additional objects and advantages of the present invention will become apparent from the following detailed description and the accompanying drawings wherein:

FIG. 3 is a cross sectional view of the drum shown in FIG. 2, taken on line 3—3 of the latter figure, the drum having a modified form of drumhead ring reducer attached thereto; and FIG. 4 is an enlarged cross sectional view of a drumhead ring reducer before the installation thereof on a drum.

Figure 1:
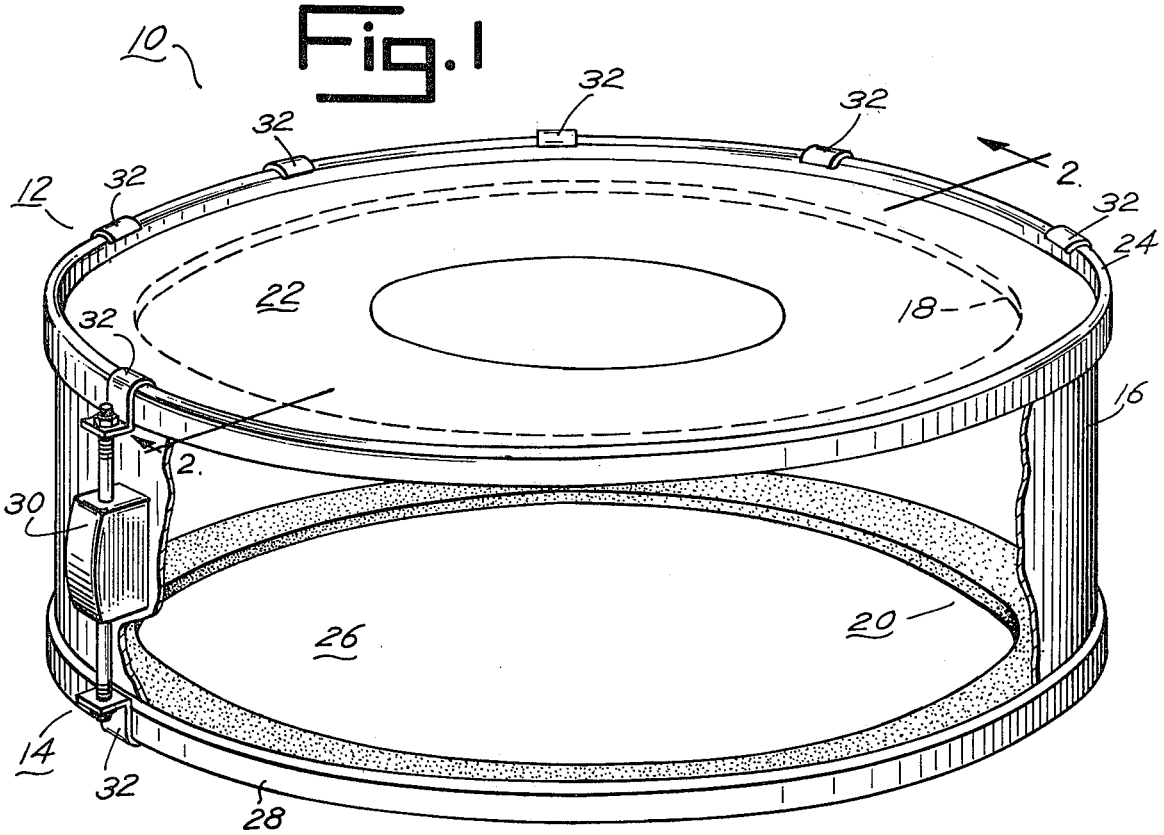
FIG. 1 is a perspective view, partially broken away, of a dual headed drum having drumhead ring reducers embodying the present invention for both the attack and resonating heads.
Figure 2:
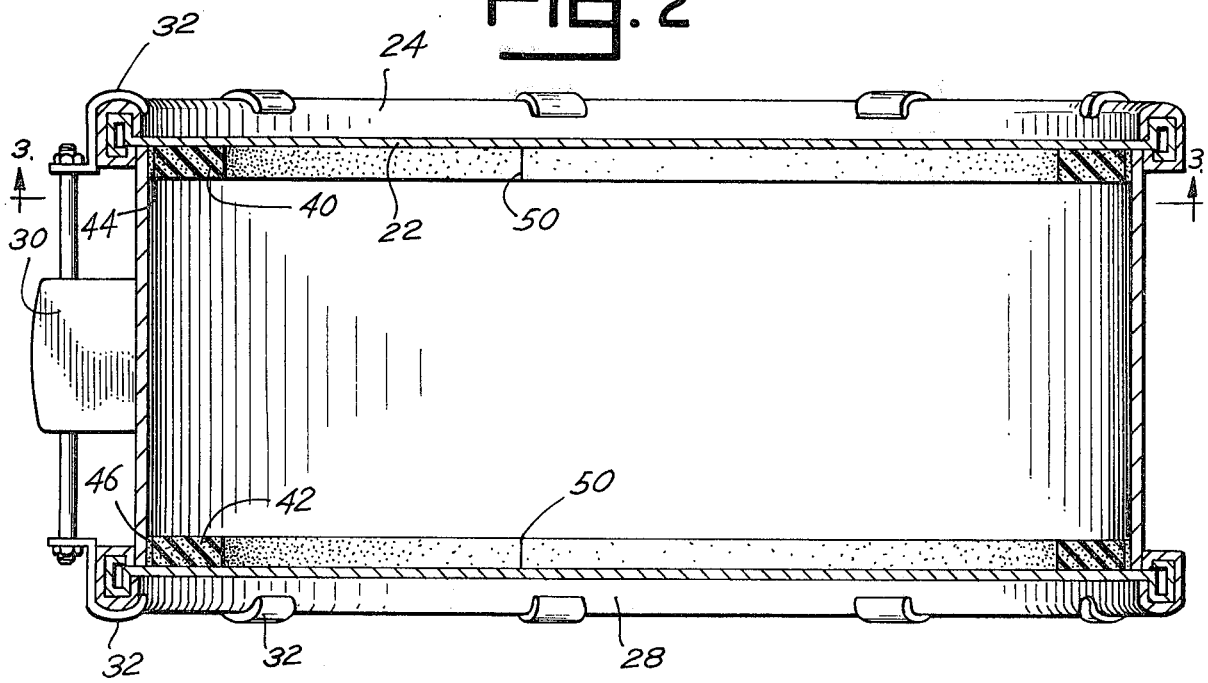
FIG. 2 is a cross sectional view of the dual headed drum and drumhead ring reducers shown in FIG. 1, taken on line 2—2 of the latter figure.

Referring more specifically to the drawings and to FIG. 1 in particular, numeral 10 designates a dual headed drum having an attack head 12 and a resonating head 14 on a drum shell 16. Drumhead ring reducers 18 and 20 are attached to shell 16 to operate effectively with the attack head and resonating head, respectively, to reduce the ringing phenomenon. Ring reducers embodying the present invention operate as effectively on single headed drums as on the dual headed drum shown in FIG. 1, and will operate equally well on drums of various sizes from small diameter tom-tom drums to large diameter bass drums.

Drum 10 is a conventional drum structure with attack head 12 having a membrane 22 attached to a rim 24, and resonating head 14 having a membrane 26 attached to a rim 28. The membranes are of plastic such as nylon or other synthetic material commonly used in drumhead membranes, or they may be of calf skin or other natural products. The present drumhead ring reducer will work equally well on synthetic membranes and natural membranes; however, since the ringing phenomenon is more pronounced in synthetic membranes than in natural membranes, the present device is more advantageous when used on a synthetic membrane. To provide the necessary drum membrane tension, membranes 22 and 26 are stretched over shell 16 by a plurality of tensioning devices 30, which are attached to shell 16 and have clamps 32 for holding rims 24 and 28. The devices may be adjusted to tighten the membrane against shell 16.

Ring reducers 19 and 20 bear against the inner side of the respective membranes and consist of bodies 40 and 42, respectively, of porous pliable material such as foam rubber, polyester foam or the like. Adhesive layers 44 and 46 are disposed on the outer edge of bodies 40 and 42 for attaching the bodies to drum shell 16. Any adhesive suitable for use on the material of bodies 40 and 42 may be used; however, the types of adhesive commonly used on bumper stickers and the like are particularly appropriate, as are other types of contact or pressure sensitive adhesives, in that these types of adhesives will permit the use of a removable protective layer 48 on the adhesive. Hence, the bodies are normally manufactured and sold with the adhesive on the body and the protective layer 48 covering the adhesive. During installation of the body, the protective layer is removed and the body attached without further application of adhesive. The protective layer protects the adhesive during packing, shipping and storing of the ring reducer, yet is readily removable when the reducer is to be installed on the drum shell. In place of the preapplied adhesive, liquid adhesive applied directly to the body or the drum shell may be used, if desired, to secure the body to the drum shell.

Bodies 40 and 42 may be of a single segment having an annular shape, or may be a strip of sufficient length to extend around the inner periphery of the shell with its ends meeting generally at the point indicated with the numeral 50. A modified form of ring reducer is shown in FIG. 3, wherein the body of the reducer includes segments 60, 62, 64 and 66 which are disposed adjacent each other around the inner periphery of the drum shell. Adhesive layers 68 are provided on each of the segments to attach the segments to the drum shell. More or fewer segments than the four shown in FIG. 3 may be used in the body of the ring reducer to achieve the ease of installation desired for the size of drum on which the ring reducer is installed. Marketing of the ring reducer can be simplified by including sufficient numbers of segments of appropriate lengths in a single package to be installed on a number of drums of various sizes. For example, one package may contain a sufficient number of segments for one large drum, both heads of a dual headed drum, or two small drums. In some applications it may be desirable to install the segments of the body with a space or gap between the adjacent ends; however, normally either a single body or a multiple segment body with adjacent ends abutting each other will be used.

In the use and operation of a drumhead ring reducer embodying the present invention, the body or bodies of the ring reducer are attached by the adhesive layer to the drum shell. The bodies are positioned on the shell so that a surface of the body is in contact with the drum membrane and continually bears against the inner side of the respective membrane. Hence, on the dual headed drum structure shown in FIG. 1, ring reducer 18 is attached to shell 16 so that the upper surface is in contact with membrane 22, and ring reducer 20 is attached to the shell so that the lower surface thereof is in contact with membrane 26. When a body having a plurality of segments is used for the ring reducer, each of the segments is attached to the membrane so that a portion of the porous and pliable segment will be in contact with the membrane. The body or bodies are attached by peeling protective layer 48 from the adhesive and pressing the adhesive layer against the drum shell. If the adhesive has not been provided during the manufacture of the body, a layer of suitable adhesive is applied, either to the body or to the drum shell, before the body is attached thereto. If suitable adhesives are used, the body will remain permanently attached to the drum shell to operate effectively with the membranes to reduce drumhead ring. Since the bodies are made of foam rubber, polyester foam or the like, they will not add substantially to the weight of the drum, and since they remain permanently attached, they are suitable for use on marching drums. When the drum is played, the bodies of the present ring reducer do not substantially interfere with the originating and desired drum tones, quality and volume; however, the bodies do substantially eliminate the undesired drumhead ring.

One of the particular advantages of the present drumhead ring reducer is that when the body or bodies are installed on the drum shell, they will remain permanently attached thereto. Hence, if the drum membrane breaks, or if a different type of membrane is desired for a particular performance, the membrane may be changed, and the ring reducer will remain in place to operate effectively with the newly installed membrane. It is not necessary to install a ring reducer on the new membrane, nor is it necessary to carry additional ring reducers to be used if a membrane has to be replaced. The membrane may be changed as quickly as it would if a ring reducer were not provided on the drum, in that the ring reducer is contained within the shell and does not interfere with the replacement of the membrane. The bodies of the present ring reducer may be manufactured in a variety of different colors to match the drum shell or the color scheme of the band; hence, they will not detract from, but will enhance the appearance of, drums having transparent membranes.

Although one embodiment and several modifications of a drumhead ring reducer have been shown and described in detail herein, various other changes may be made without departing from the scope of the present invention.

I claim:

1. In a musical drum having a drum shell and a drumhead membrane: a drumhead ring reducer comprising an annular body of porous pliable material disposed in contact with the inner side of the membrane for reacting with the membrane without substantially muffling the percussive drum sounds to reduce the ringing phenomenon, and a layer of adhesive on said body for attaching said body to the inner surface of the drum shell.

2. In a musical drum: a drumhead ring reducer as defined in claim 1 in which said body is attached near the edge of the shell.

3. In a musical drum: a drumhead ring reducer as defined in claim 2 in which said porous pliable material is polyester foam.

4. In a musical drum: a drumhead ring reducer as defined in claim 3 in which a protective layer is disposed on said adhesive layer for packaging and marketing, and said protective layer is adapted to be removed when said body is attached to the drum shell.

5. In a musical drum: a drumhead ring reducer as defined in claim 1 in which said body includes a plurality of segments disposed adjacent each other around the drum shell.

6. In a musical drum: a drumhead ring reducer as defined in claim 5 in which each of said segments is of polyester foam.

7. In a musical drum: a drumhead ring reducer as defined in claim 5 in which each of said segments is attached near the edge of the shell.

8. In a musical drum: a drumhead ring reducer as defined in claim 7 in which each of said segments is of polyester foam.

9. In a musical drum: a drumhead ring reducer as defined in claim 8 in which a protective layer is disposed on said adhesive of each of said segments for packaging and marketing, and said protective layers are adapted to be removed when said segments are attached to the drum shell.

10. In a musical drum: a drumhead ring reducer as defined in claim 1 in which said porous pliable material is polyester foam.

11. In a musical drum: the combination comprising a drum shell, a drumhead membrane attached to said shell, and a drumhead ring reducer including a body of porous pliable material attached to the shell and having a surface disposed in contact with the inner side of the membrane for reacting with the membrane to reduce drumhead ring without substantially muffling the percussive drum sounds, and an adhesive for attaching said body to said shell in close proximity to said membrane.

12. In a musical drum: the combination as defined in claim 11 in which said body includes a plurality of segments disposed adjacent each other around the drum shell.

13. In a musical drum: the combination as defined in claim 12 in which said porous pliable material is polyester foam.

14. In a musical drum: the combination as defined in claim 11 in which said porous pliable material is polyester foam.

* * * * *